US009918610B2

(12) United States Patent
Tobbe

(10) Patent No.: US 9,918,610 B2
(45) Date of Patent: Mar. 20, 2018

(54) FLUID CIRCULATION ASSEMBLY FOR A DISHWASHER APPLIANCE

(71) Applicant: General Electric Company, Schenectady, NY (US)

(72) Inventor: Joseph Duane Tobbe, Taylorsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 158 days.

(21) Appl. No.: 14/937,195

(22) Filed: Nov. 10, 2015

(65) Prior Publication Data

US 2017/0127904 A1 May 11, 2017

(51) Int. Cl.
*A47L 15/42* (2006.01)

(52) U.S. Cl.
CPC ..... *A47L 15/4208* (2013.01); *A47L 15/4206* (2013.01); *A47L 15/4221* (2013.01); *A47L 15/4225* (2013.01); *A47L 15/4246* (2013.01)

(58) Field of Classification Search
None
See application file for complete search history.

(56) References Cited

U.S. PATENT DOCUMENTS 5,630,437 A 5/1997 Dries et al.
6,782,899 B2 8/2004 Kim et al.
8,377,228 B2 * 2/2013 Mersch ..... A47L 15/4202 134/56 D
2006/0237050 A1 10/2006 Weaver et al.

FOREIGN PATENT DOCUMENTS

WO WO2012143286 A1 10/2012

* cited by examiner

*Primary Examiner* — Michael Barr
*Assistant Examiner* — Jason Riggleman
(74) *Attorney, Agent, or Firm* — Dority & Manning, P.A.

(57) ABSTRACT

A fluid circulation assembly for a dishwasher appliance includes a collection chamber positioned below a sump. A first outlet conduit extends from a valve and is configured for receiving liquid from a pump when the valve is in a recirculation configuration, and a second outlet conduit extends from the valve and is configured for directing liquid from the pump to the collection chamber when the valve is in a drain configuration. A check valve is configured for obstructing liquid flow from the collection chamber to an unfiltered volume of the sump when the valve is in the drain configuration.

18 Claims, 6 Drawing Sheets

FLUID CIRCULATION ASSEMBLY FOR A DISHWASHER APPLIANCE

FIELD OF THE INVENTION

The present subject matter relates generally to dishwasher appliances.

BACKGROUND OF THE INVENTION

Dishwasher appliances generally include a tub and spray assemblies. The spray assemblies direct sprays of wash fluid onto articles within the tub during operation of the dishwasher appliance, and the wash fluid sprayed from spray assemblies eventually flows to a sump typically positioned at a bottom portion of the tub. To supply wash fluid to the spray assemblies, dishwasher appliances generally include a recirculation pump, which may receive wash fluid from the sump to recirculate within the tub.

To protect the recirculation pump and to prevent food and other undesirable particles from being sprayed onto the articles when the wash fluid is recirculated, one or more filters usually are positioned in the sump upstream of the pump to filter the particles from the wash fluid. During wash cycles, the filters can saturate with particles and clog, and clogged filters can negatively affect performance of dishwasher appliances. Thus, dishwasher appliance users are instructed to remove and clean the filters at regular intervals. However, removing and cleaning filters can be tedious and inconvenient. Accordingly, a dishwasher appliance with features for assisting with cleaning filters of the dishwasher appliance would be useful.

After wash cycles are complete, soiled wash fluid is removed or drained from the tub. Dishwasher appliances generally include a separate drain pump that is operable to drain the soiled wash fluid from the sump. However, providing a drain pump that is separate from the recirculation pump can increase a cost of the associated dishwasher appliance. Accordingly, a dishwasher appliance with features for recirculating wash fluid within the tub and for draining wash fluid from the tub without requiring multiple pumps would be useful.

BRIEF DESCRIPTION OF THE INVENTION

The present subject matter provides a fluid circulation assembly for a dishwasher appliance. The fluid circulation assembly includes a collection chamber positioned below a sump. A first outlet conduit extends from a valve and is configured for receiving liquid from the pump when the valve is in a recirculation configuration, and a second outlet conduit extends from the valve and is configured for directing liquid from the pump to the collection chamber when the valve is in a drain configuration. A check valve is configured for obstructing liquid flow from the collection chamber to an unfiltered volume of the sump when the valve is in the drain configuration. Additional aspects and advantages of the invention will be set forth in part in the following description, or may be apparent from the description, or may be learned through practice of the invention.

In a first exemplary embodiment, a dishwasher appliance is provided. The dishwasher appliance includes a tub having a sump positioned at a bottom portion of the tub. A spray body is disposed within the tub. A filter is positioned within the sump. The filter is disposed between a filtered volume of the sump and an unfiltered volume of the sump. A collection chamber is positioned below the sump such that an inner wall of the sump is disposed between the collection chamber and the unfiltered volume of the sump. An entrance of the collection chamber is positioned such that the entrance of the collection chamber is contiguous with the unfiltered volume of sump. The collection chamber also has a drain exit. A supply conduit is mounted to the sump. An entrance of the supply conduit is positioned such that the entrance of the supply conduit is contiguous with the filtered volume of sump. A pump is coupled to the supply conduit and is operable to urge liquid from the filtered volume of sump into the supply conduit. A valve is fluidly coupled to the pump. The valve is selectively adjustable between a recirculation configuration and a drain configuration. A first outlet conduit extends from the valve and is configured for supplying liquid from the pump to the spray body when the valve is in the recirculation configuration. A second outlet conduit extends from the valve and is configured for directing liquid from the pump to the collection chamber when the valve is in the drain configuration. A check valve is positioned at the entrance of the collection chamber. The check valve is configured for obstructing liquid flow from the collection chamber to the unfiltered volume of the sump via the entrance of the collection chamber such that liquid in the collection chamber exits the collection chamber via the drain exit when the valve is in the drain configuration.

In a second exemplary embodiment, a fluid circulation assembly for a dishwasher appliance is provided. The fluid circulation assembly includes a sump. A filter is positioned within the sump. The filter is disposed between a filtered volume of the sump and an unfiltered volume of the sump. A collection chamber is positioned below the sump such that an inner wall of the sump is disposed between the collection chamber and the unfiltered volume of the sump. An entrance of the collection chamber is positioned such that the entrance of the collection chamber is contiguous with the unfiltered volume of sump. The collection chamber also has a drain exit. A supply conduit is mounted to the sump. An entrance of the supply conduit is positioned such that the entrance of the supply conduit is contiguous with the filtered volume of sump. A pump is coupled to the supply conduit and is operable to urge liquid from the filtered volume of sump into the supply conduit. A valve is fluidly coupled to the pump. The valve is selectively adjustable between a recirculation configuration and a drain configuration. A first outlet conduit extends from the valve and is configured for receiving liquid from the pump when the valve is in the recirculation configuration. A second outlet conduit extends from the valve and is configured for directing liquid from the pump to the collection chamber when the valve is in the drain configuration. A check valve is positioned at the entrance of the collection chamber. The check valve is configured for obstructing liquid flow from the collection chamber to the unfiltered volume of the sump via the entrance of the collection chamber such that liquid in the collection chamber exits the collection chamber via the drain exit when the valve is in the drain configuration.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
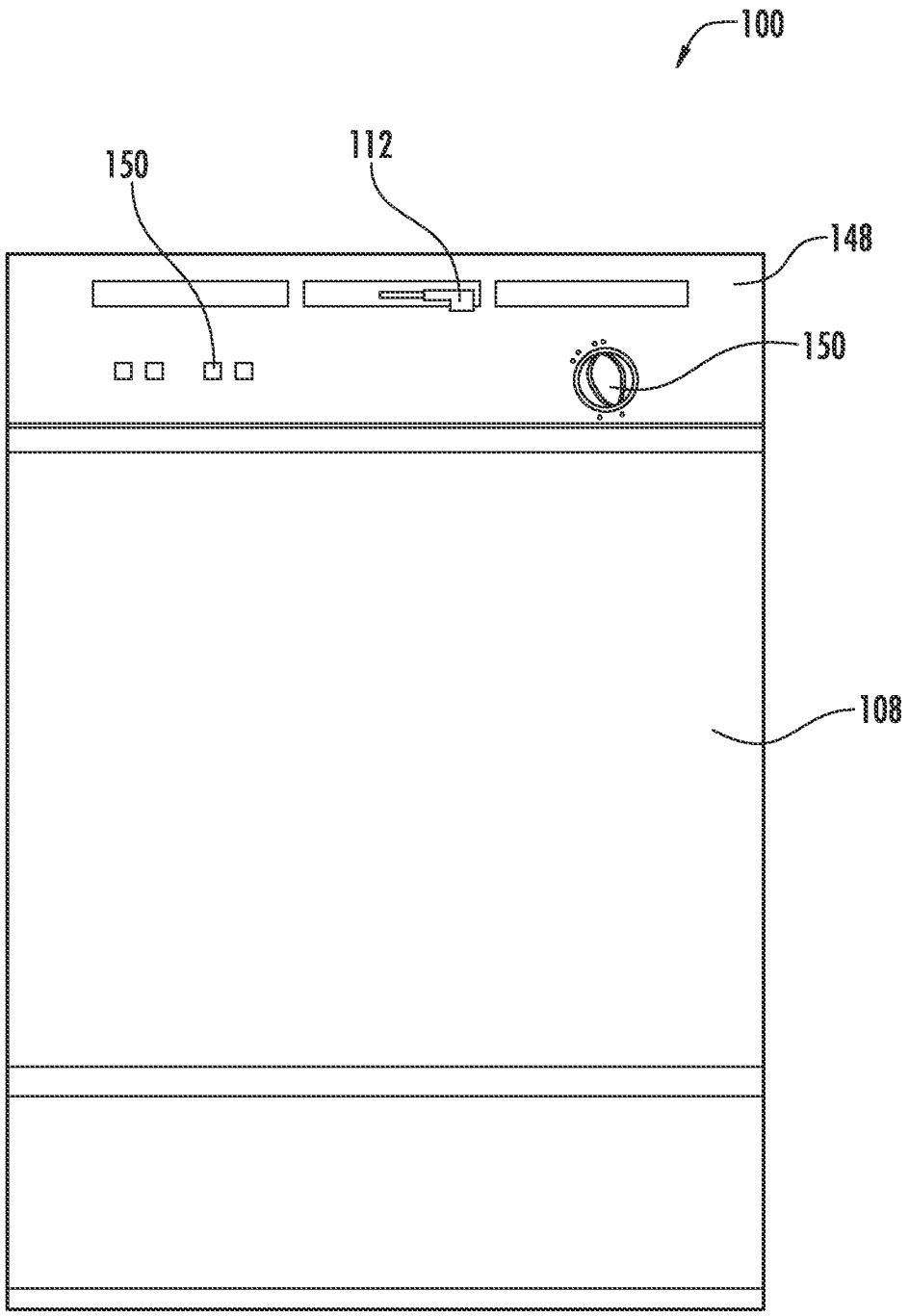
FIG. 1 provides a front view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
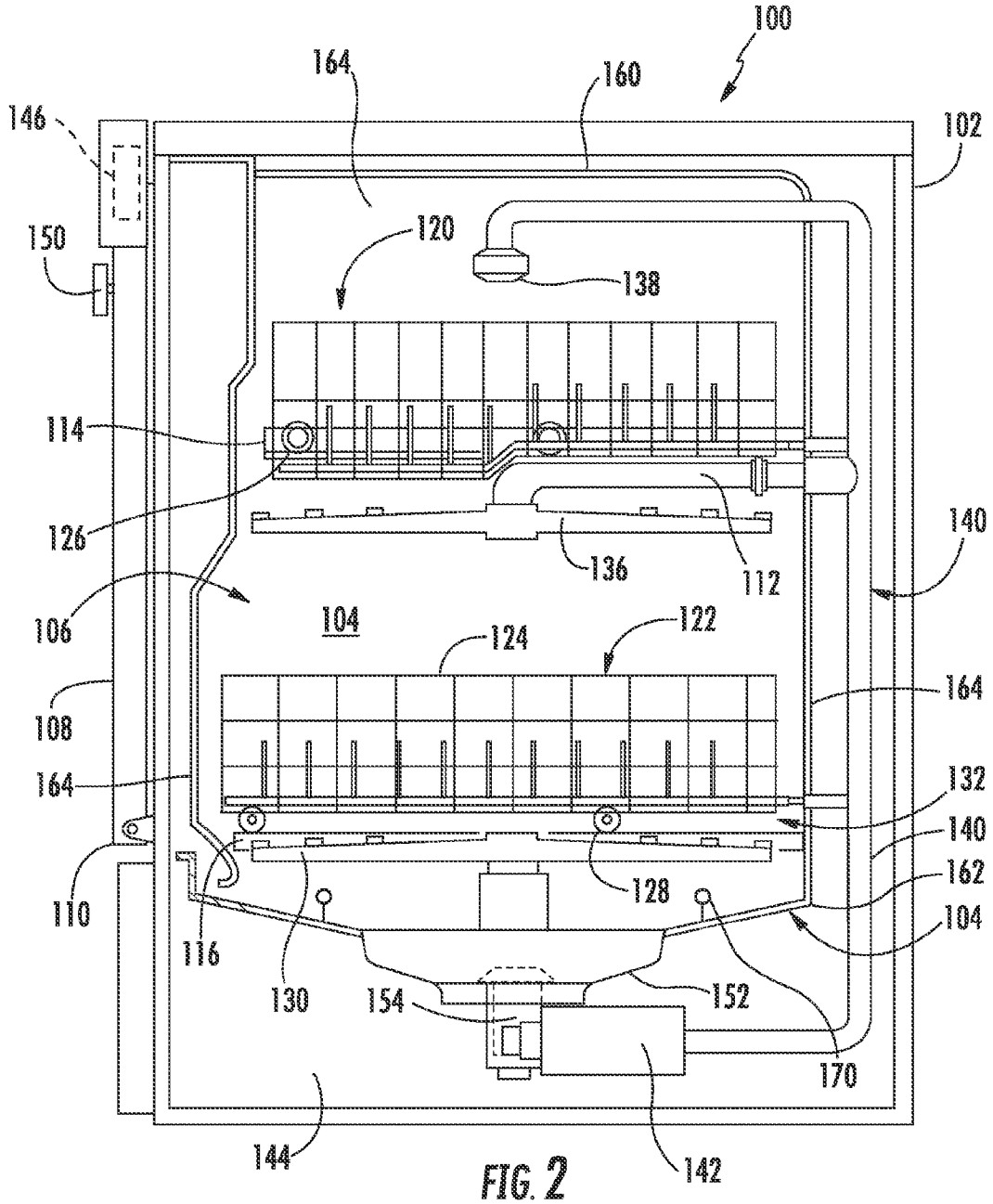
FIG. 2 provides a section view of the exemplary dishwasher appliance of FIG. 1.

FIGS. 1 and 2 depict one exemplary embodiment of a dishwasher appliance 100 that may be configured in accordance with aspects of the present subject matter. As shown in FIGS. 1 and 2, dishwasher appliance 100 may include a cabinet 102 having a tub 104 therein defining a wash chamber 106. Tub 104 may generally include a front opening (not shown) and a door 108 hinged at its bottom 110 for movement between a normally closed vertical position (shown in FIGS. 1 and 2), wherein wash chamber 106 is sealed shut for washing operation, and a horizontal open position for loading and unloading of articles from dishwasher appliance 100. As shown in FIG. 1, a latch 112 may be used to lock and unlock door 108 for access to chamber 106.

Tub 104 may generally have a rectangular cross-section defined by various wall panels and/or walls. For example, as shown in FIG. 2, tub 104 may include a top wall 160 and a bottom wall 162 spaced apart from one another along a vertical direction V of dishwasher appliance 100. Additionally, tub 104 may include a plurality of sidewalls 164 (e.g., three sidewalls) extending between top and bottom walls 160, 162.

As particularly shown in FIG. 2, upper and lower guide rails 114, 116 may be mounted on opposing side walls 164 of tub 104 and may be configured to accommodate roller-equipped rack assemblies 120 and 122 configured for supporting articles for washing within wash chamber 106 of tub 104. Each of rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack is substantially positioned outside wash chamber 106, and a retracted position (shown in FIGS. 1 and 2) in which the rack is located inside wash chamber 106. This may be facilitated by rollers 126 and 128, for example, mounted onto racks 120 and 122, respectively. As is generally understood, a silverware basket (not shown) may be removably attached to rack assembly 122 for placement of silverware, utensils, and the like, that are otherwise too small to be accommodated by rack assemblies 120, 122.

Additionally, dishwasher appliance 100 may also include a lower spray-arm assembly 130 that is configured to be rotatably mounted within a lower region 132 of wash chamber 106 directly above bottom wall 162 of tub 104 so as to rotate in relatively close proximity to rack assembly 122. As shown in FIG. 2, a mid-level spray-arm assembly 136 may be located in an upper region of wash chamber 106, such as by being located in close proximity to upper rack 120. Moreover, an upper spray assembly 138 may be located above upper rack 120.

As is generally understood, lower and mid-level spray-arm assemblies 130, 136 and upper spray assembly 138 may generally form part of a fluid circulation assembly 140 for circulating water and dishwasher fluid within tub 104. As shown in FIG. 2, fluid circulation assembly 140 may also include a pump 142 located in a machinery compartment 144 located below bottom wall 162 of tub 104, as is generally recognized in the art. Additionally, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of lower spray-arm assembly 130 provides coverage of dishes and other dishwasher contents with a washing spray.

Dishwasher appliance 100 may be further equipped with a controller 146 configured to regulate operation of dishwasher appliance 100. Controller 146 can include any number of control devices and can generally include one or more memory devices and one or more processors, such as one or more general or special purpose microprocessors operable to execute programming instructions or micro-control code associated with a cleaning cycle. The processors and/or memory devices can be configured to perform a variety of computer-implemented functions and/or instructions (e.g. performing the methods, steps, calculations and the like and storing relevant data as disclosed herein). The instructions when executed by the processor(s) can cause the processor (s) to perform operations, including providing control commands to various aspects of dishwasher appliance 100.

As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. The processor is also configured to compute advanced control algorithms and communicate to a variety of Ethernet or serial-based protocols (Modbus, OPC, CAN, etc.). Additionally, the memory device(s) may generally comprise memory element(s) including, but not limited to, computer readable medium (e.g. random access memory (RAM)), computer readable non-volatile medium (e.g. read-only memory, or a flash memory), a floppy disk, a compact disc-read only memory (CD-ROM), a magneto-optical disk (MOD), a digital versatile disc (DVD) and/or other suitable memory elements. Such memory device(s) may generally be configured to store suitable computer-readable instructions that, when implemented by the processor(s), configure controller 104 to perform the various functions as described herein. The memory may be a separate component from the processor or may be included onboard within the processor. Controller 146 may also include or be configured as an electro-mechanical timer.

Controller 146 may be positioned in a variety of locations throughout dishwasher appliance 100. In the illustrated exemplary embodiment, controller 146 is located within a control panel area 148 of door 108, as shown in FIG. 1. In such an exemplary embodiment, input/output ("I/O") signals may be routed between the control system and various operational components of dishwasher appliance 100 along wiring harnesses that may be routed through bottom 110 of door 108.

Typically, controller 146 includes a user interface panel/controls 150 through which a user may select various operational features and modes and monitor progress of dishwasher appliance 100. In one exemplary embodiment, user interface 150 may represent a general purpose I/O ("GPIO") device or functional block. Additionally, user interface 150 may include input components, such as one or more of a variety of electrical, mechanical or electro-mechanical input devices including rotary dials, push buttons, and touch pads. User interface 150 may also include a display component, such as a digital or analog display device designed to provide operational feedback to a user. As is generally understood, user interface 150 may be in communication with controller 146 via one or more signal lines or shared communication busses.

Additionally, as shown in FIG. 2, a portion of bottom wall 162 of tub 104 may be configured as a tub sump portion 152 that accommodates a filter assembly 154 configured to remove particulates from the fluid being recirculated through wash chamber 106 during operation of dishwasher appliance 100. For example, fluid collected within tub sump portion 152 of bottom wall 162 may be passed through filter assembly 154 and then diverted back to pump 142 for return to wash chamber 106 by way of the fluid recirculation assembly 140. Moreover, as shown in FIG. 2, dishwasher appliance 100 may also include a heating element 170 provided in operative association with tub 104 for providing heat energy during a wash, rinse, and/or drying cycle to, for example, heat the fluid introduced into wash chamber 106 and/or to assist with drying articles.

Figure 3:
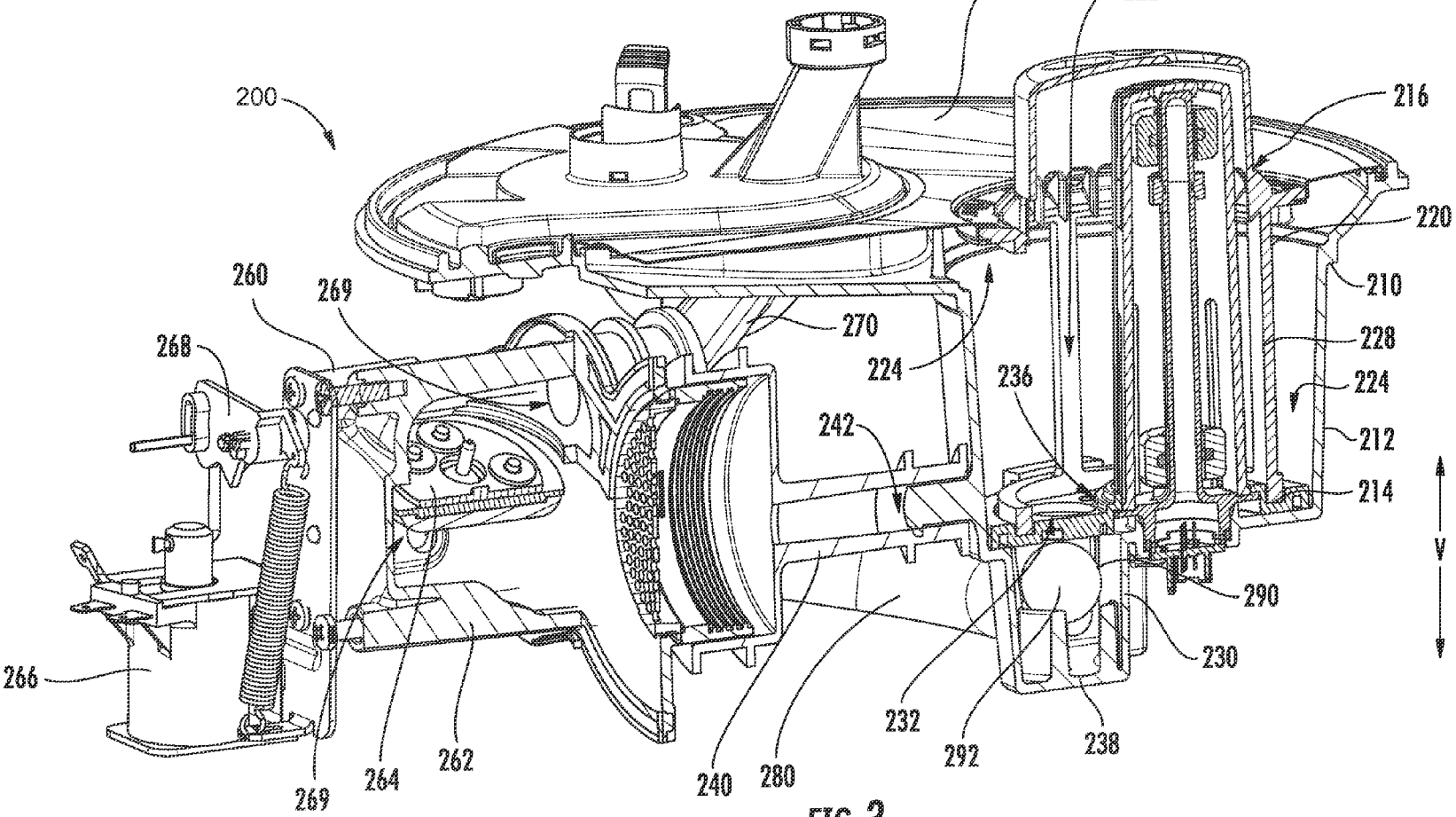
FIG. 3 provides a perspective section view of a fluid assembly according to an exemplary embodiment of the present subject matter.
Figure 4:
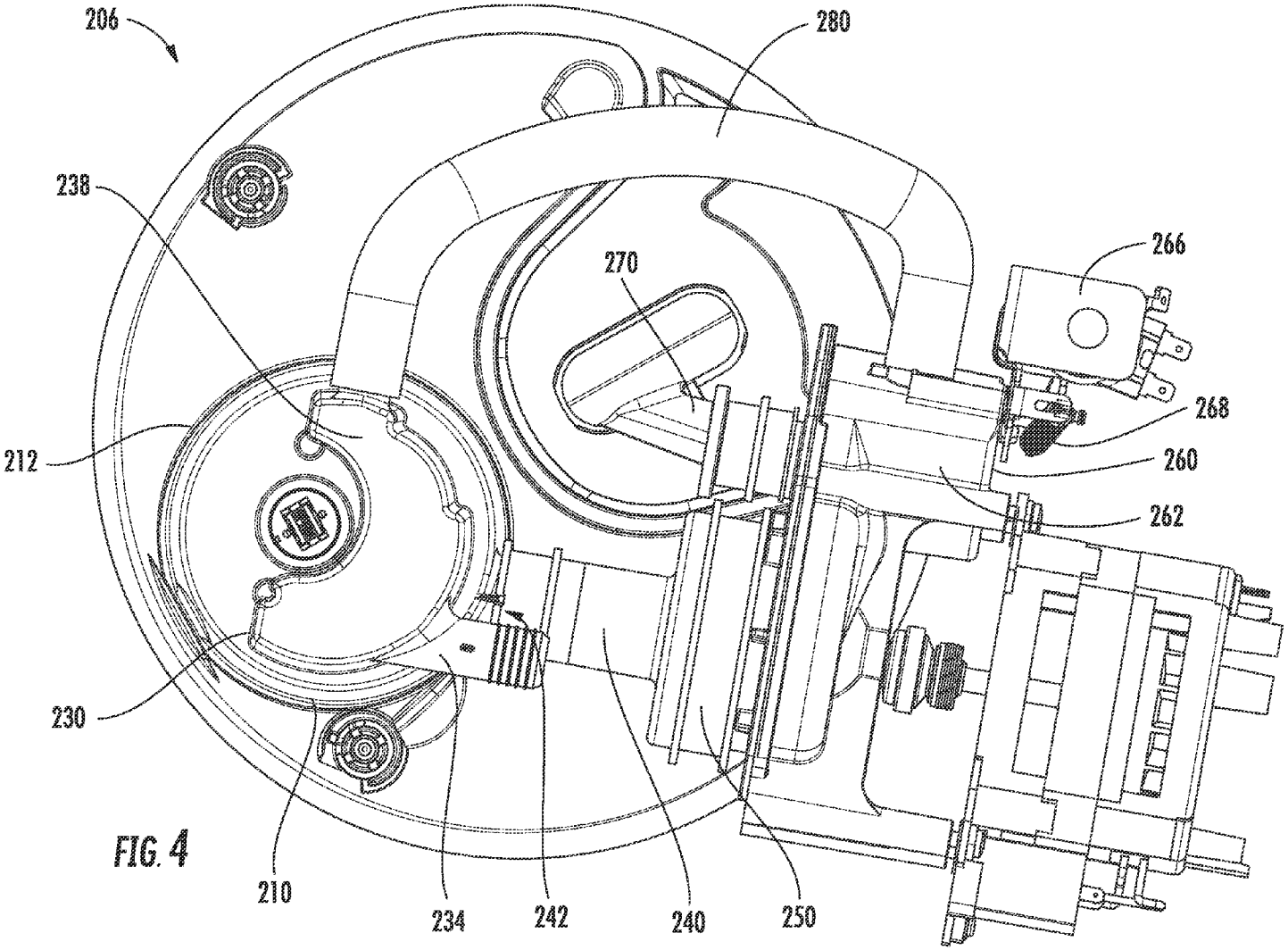
FIG. 4 provides a bottom plan view of the exemplary fluid assembly of FIG. 3.
Figure 5:
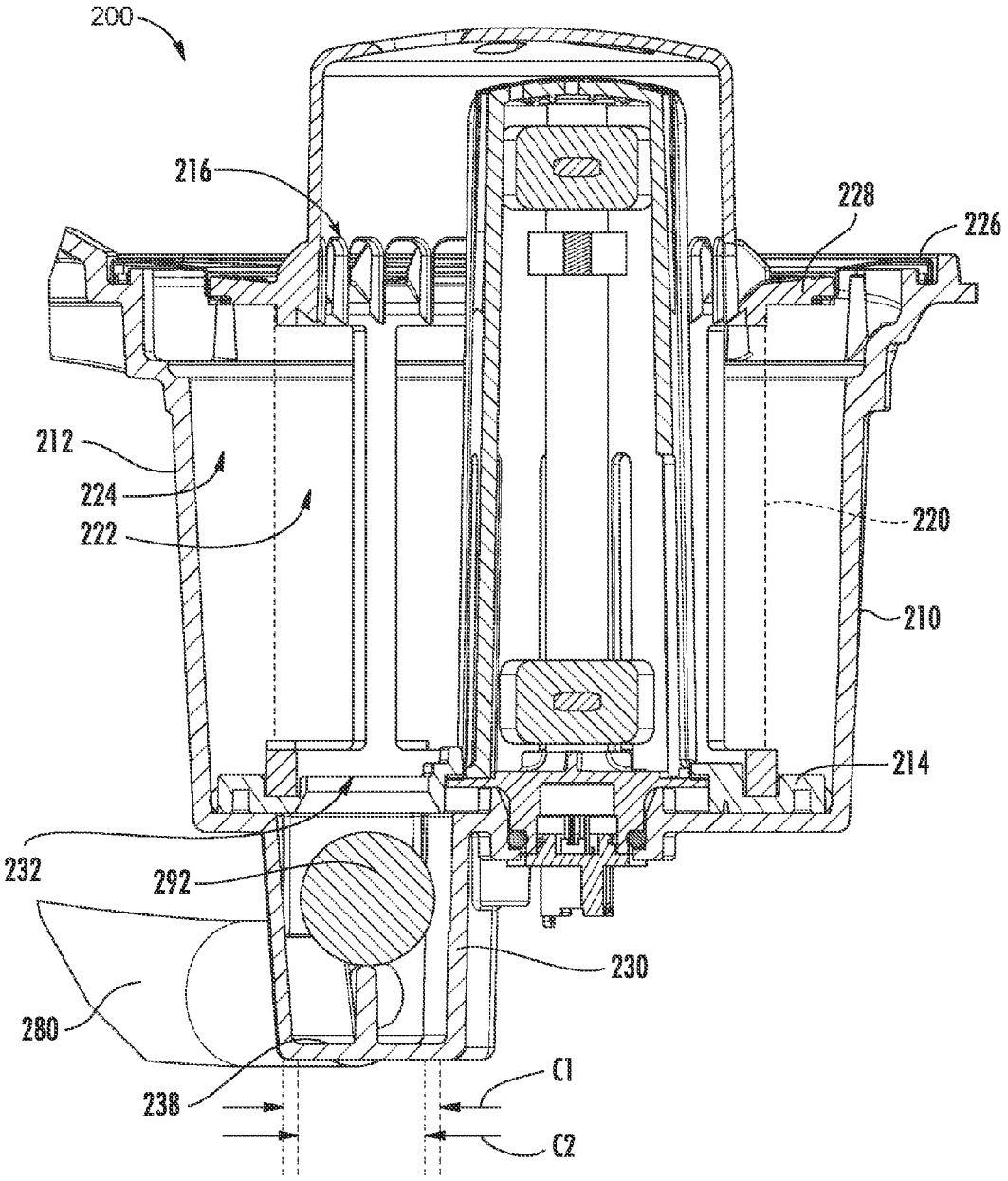
FIGS. 5 and 6 provide partial, section views of the exemplary fluid assembly of FIG. 3.
Figure 6:
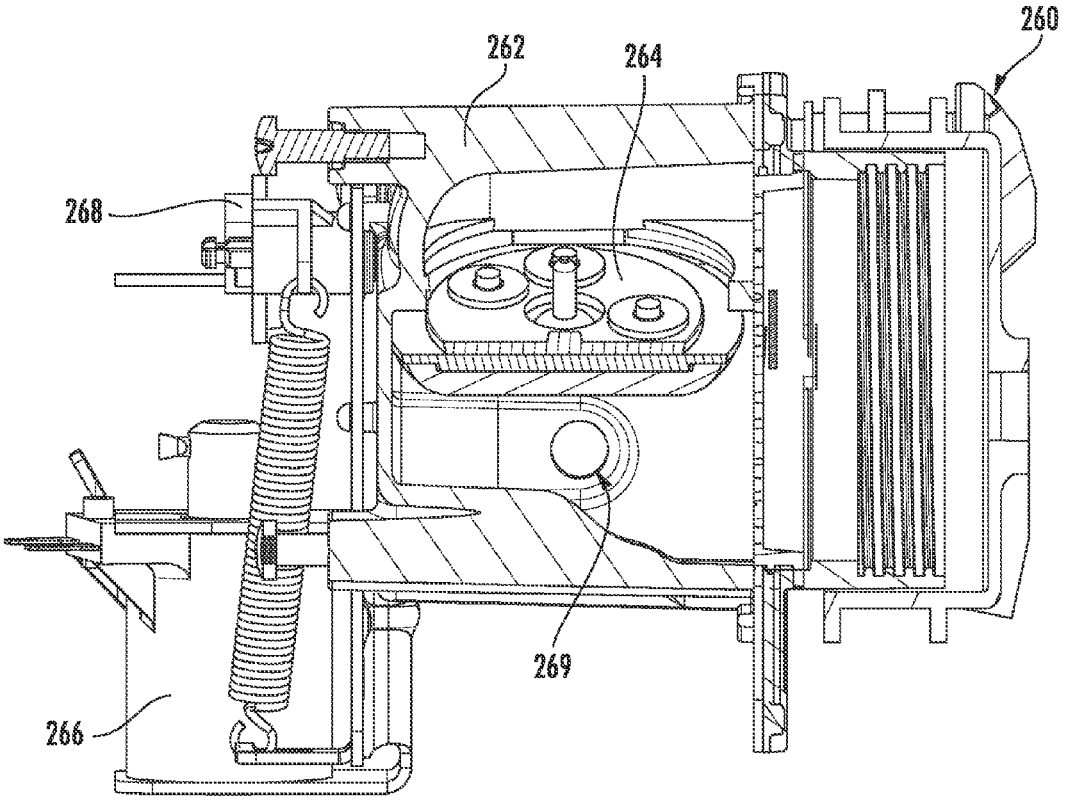

FIG. 3 provides a perspective section view of a fluid assembly 200 according to an exemplary embodiment of the present subject matter. FIG. 4 provides a bottom plan view of fluid assembly 200. FIGS. 5 and 6 provide partial, section views of fluid assembly 200. Fluid assembly 200 may be utilized within any suitable dishwasher appliance. For example, fluid assembly 200 may be used within dishwasher appliance 100, e.g., as tub sump portion 152 to recirculate and/or drain wash fluid within dishwasher appliance 100. Thus, tub sump portion 152 may be configured or constructed in the manner described below of fluid assembly 200, and fluid assembly 200 is discussed in greater detail below in the context of dishwasher appliance 100.

As may be seen in FIG. 3, fluid assembly 200 includes a sump 210 and a filter 220. Sump 210 may be mounted to tub 104. Filter 220 is positioned within sump 210. In particular, filter 220 is disposed between a filtered volume 224 of sump 210 and an unfiltered volume 222 of sump 210. Thus, filter 220 may assist with forming or defining unfiltered and filtered volumes 222, 224 of sump 210 within sump 210. As used herein, the terra. "unfiltered" describes a volume that is not filtered relative to filter 220 and the term "filtered" describes a volume that is filtered relative to filter 220. However, as will be understood by those skilled in the art, fluid assembly 200 may include additional filters that filter liquid entering unfiltered volume 222. Thus, unfiltered volume 222 may be filtered relative to other filters, such as a coarse filter, but not filter 220.

A filter medium may be mounted to a cylindrical frame 228 of filter 220. The filter media of filter 220 can be any suitable filtering material or mechanism. For example, the filter media may be a plastic or metal mesh. Filter 220 can be can be configured for fine filtration—e.g. filtering of relatively small particles. Accordingly, in one exemplary aspect of the present subject matter, a filter media of filter 220 may be configured (e.g., define holes or apertures) for removing particles in the size range of about fifty microns to about four hundred microns. For example, filter 220 may include a screen or mesh having holes in the size range of about fifty microns to about four hundred microns. In another exemplary aspect of the present subject matter, filter 220 may be configured (e.g., define holes or apertures) for removing particles in the size range of about three hundred microns to about six hundred microns. For example, filter 220 may include a screen or mesh having holes in the size range of about three hundred microns to about six hundred microns. These size ranges are provided by way of example only. Other ranges may be used in certain exemplary embodiments of the present subject matter as well.

Sump 210 also defines openings 216 above unfiltered volume 222 of sump 210. Openings 216 of sump 210 may be contiguous with wash chamber 106 of tub 104. Thus, wash fluid from wash chamber 106 of tub 104 may flow into unfiltered volume 222 of sump 210 via openings 216 of sump 210.

Fluid assembly 200 may also include an additional (e.g., coarse) filter 226. Additional filter 226 may be positioned over filtered volume 224 of sump 210, and filter liquid entering filtered volume 224 of sump 210. Thus, additional filter 226 may be positioned between wash chamber 106 of tub 104 and filtered volume 224 of sump 210 along the vertical direction V. Additional filter 226 may be configured as a coarse filter, e.g., with large pores or apertures relative to filter 220. A top surface of additional filter 226 may also be sloped or inclined towards openings 216 of sump 210 and/or unfiltered volume 222 of sump 210, e.g., such that particles or debris on the top surface of additional filter 226 are swept into unfiltered volume 222 of sump 210 via openings 216 of sump 210 during operation of dishwasher appliance 100.

Fluid assembly 200 also includes a collection chamber 230. Collection chamber 230 is positioned below sump 210, e.g., along the vertical direction V. In particular, a bottom or inner wall 214 of sump 210 may be disposed between unfiltered volume 222 of sump 210 and collection chamber 230. Collection chamber 230 provides a volume for accumulation of particulates and debris from unfiltered volume 222 of sump 210, as discussed in greater detail below.

Collection chamber 230 defines an entrance 232 and a drain outlet 234. Entrance 232 of collection chamber 230 is contiguous with unfiltered volume 222 of sump 210. As will be understood by those skilled in the art, particulates and debris within unfiltered volume 222 of sump 210 may settle downwardly, e.g., due to gravity. Entrance 232 of collection chamber 230 may be positioned at a bottom of unfiltered volume 222 of sump 210, as shown in FIG. 3. Thus, particulates and debris from unfiltered volume 222 of sump 210 may pass through entrance 232 of collection chamber 230 and settle into collection chamber 230. Drain outlet 234 may be fluidly coupled to a suitable septic or sewer system (e.g., with a hose or pipe) and provide a path for removal of wash fluid and the particulates and debris from collection chamber 230.

A supply conduit 240 is mounted to sump 210. In particular, an entrance 242 of supply conduit 240 may be positioned such that entrance 242 of supply conduit 240 is contiguous with filtered volume 224 of sump 210. Thus, supply conduit 240 may receive filtered wash fluid from filtered volume 224 of sump 210 via entrance 242 of supply conduit 240. A pump 250 is coupled to supply conduit 240. Pump 250 is operable or configured to draw wash fluid from filtered volume 224 of sump 210 into supply conduit 240. Thus, when activated, pump 250 draws wash fluid into supply conduit 240 from filtered volume 224 of sump 210. Pump 250 may be the only pump within dishwasher appliance 100 for recirculating wash fluid within tub 104 and for draining wash fluid from tub 104. Thus, fluid assembly 200 may include a single pump, i.e., only pump 250.

A valve 260 is fluidly coupled to pump 250. Thus, valve 260 may receive a flow of wash fluid from or to pump 250. Valve 260 is selectively adjustable between a recirculation configuration and a drain configuration. Thus, valve 260 is configured for adjusting a flow pattern of wash fluid within fluid assembly 200 by selectively adjusting between the recirculation configuration and the drain configuration. A first outlet conduit 270 is coupled to valve 260. For example, first outlet conduit 270 may extend from valve 260 and be configured for supplying liquid from pump 250 to a spray body (e.g., at least one of lower spray-arm assembly 130, mid-level spray-arm assembly 136 or upper spray assembly 138) when valve 260 is in the recirculation configuration. Thus, in the recirculation configuration, pump 250 draws filtered fluid from filtered volume 224 of sump 210 and supplies the filtered fluid to wash chamber 106 of tub 104 in order to clean or rinse articles within tub 104. A second outlet conduit 280 is also coupled to valve 260. For example, second outlet conduit 280 may extend from valve 260 and be configured for directing liquid from pump 250 to collection chamber 230 when valve 260 is in the drain configuration. Thus, in the drain configuration, pump 250 draws filtered fluid from filtered volume 224 of sump 210 and supplies the filtered fluid to collection chamber 230 in order to remove the wash fluid from fluid assembly 200 and rinse collection chamber 230. In such a manner, valve 260 and first and second outlet conduits 270, 280 may cooperate to either recirculate wash fluid within dishwasher appliance 100 or drain wash fluid from dishwasher appliance 100.

Valve 260 may be any suitable type of valve. For example, valve 260 may be a flapper valve and include a housing 262, a flapper 264, a solenoid 266 and a linkage 268. Housing 262 defines outlets 269. A first one of outlets 269 is contiguous with first outlet conduit 270, and a second one of outlets 269 is contiguous with second outlet conduit 280. Flapper 264 is pivotally mounted within housing 262 such that flapper 264 is positioned over the first one of outlets 269 in the drain configuration and over the second one of outlets 269 in the recirculation configuration. Solenoid 266 is coupled to flapper 264 via linkage 268 and is configured for pivoting flapper 264 within housing 262 in order to adjust valve 260 between the recirculation configuration and the drain configuration.

Fluid assembly 200 also includes a check valve 290. Check valve 290 is positioned at or adjacent entrance 232 of collection chamber 230. Check valve 290 is configured for obstructing liquid flow from collection chamber 230 to unfiltered volume 222 of sump 210 via entrance 232 of collection chamber 230. With check valve 290 blocking entrance 232 of collection chamber 230, wash fluid within collection chamber 230 (e.g., from second outlet conduit 280) exits collection chamber 230 via drain exit 234 when valve 260 is in the drain configuration. In such a manner, pump 250 may drain wash fluid from dishwasher appliance 100 and rinse collection chamber 230 when valve 260 is in the drain configuration.

Check valve 290 may be any suitable check valve. For example, check valve 290 may include a ball 292. Ball 292 may be positioned within collection chamber 230 below entrance 232 of collection chamber 230. Ball 292 may have a circumference, C1, and entrance 232 of collection chamber 230 may also have a circumference, C2. The circumference C1 of ball 292 may be any suitable circumference. For example, the circumference C1 of ball 292 may be greater than the circumference C2 of entrance 232 of collection chamber 230. Thus, when valve 260 is in the drain configuration, pump 250 may direct wash fluid into collection chamber 230, and the wash fluid may urge ball 292 upwardly against inner wall 214 at entrance 232 of collection chamber 230. With ball 292 positioned or seated against inner wall 214 at entrance 232 of collection chamber 230, ball 292 seals entrance 232 of collection chamber 230 and blocks wash fluid between unfiltered volume 222 of sump 210 and collection chamber 230 via entrance 232 of collection chamber 230. Ball 292 may also have a density that is greater than a density of water. Thus, ball 292 may rest on or against bottom wall 238 of collection chamber 230 when valve 260 is in the recirculation configuration such that particulates and debris from unfiltered volume 222 of sump 210 may settle into collection chamber 230 via entrance 232 of collection chamber 230, as discussed above.

Fluid assembly 200 may also include features for rinsing or cleaning filter 220. For example, as shown in FIG. 3, inner wall 214 of sump 210 defines at least one jet or jet passage 236. Jet 236 extends between unfiltered volume 222 of sump 210 and collection chamber 230 within inner wall 214 of sump 210. Thus, wash fluid may pass between unfiltered volume 222 of sump 210 and collection chamber 230 via jet 236. In particular, when valve 260 is in the drain configuration, pump 250 may direct wash fluid into collection chamber 230, and a portion of the pressurized wash fluid may exit collection chamber 230 via jet 236. Each jet 236 is positioned and oriented for directing a stream of liquid from collection chamber 230 towards filter 220 when valve 260 is in the drain configuration. The spray of liquid from jet 236 may impact filter 220 and knock particulates and other debris from filter 220 at unfiltered volume 222 of sump 210. Thus, liquid from jet 236 may assist with cleaning filter 220 when valve 260 is in the drain configuration.

As shown in FIG. 3, sump 210 includes a side wall 212. Side wall 212 may be circular, e.g., in a plane that is perpendicular to the vertical direction V, as shown in FIG. 3 or have any other suitable shape. Fluid assembly 200 may be formed or constructed such that side wall 212 of sump 210 and a bottom wall 238 of collection chamber 230 are integrally formed from a single, continuous piece of material. For example, side wall 212 of sump 210 and bottom wall 238 of collection chamber 230 may be formed of or with a single, continuous piece of injection molded plastic. Thus, portions of sump 210 and collection chamber 230 may be formed from a common piece of material. However, inner wall 214 of sump 210 may be a separate piece of material, such as injection molded plastic, from the single, continuous piece of material that integrally forms both side wall 212 of sump 210 and bottom wall 238 of collection chamber 230.

Thus, inner wall 214 of sump 210 and side wall 212 of sump 210 may be separate pieces or components of sump 210.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub having a sump positioned at a bottom portion of the tub;

a spray body disposed within the tub;

a filter positioned within the sump, the filter disposed between a filtered volume of the sump and an unfiltered volume of the sump;

a collection chamber positioned below the sump such that an inner wall of the sump is disposed between the collection chamber and the unfiltered volume of the sump, an entrance of the collection chamber positioned such that the entrance of the collection chamber is contiguous and in fluid communication with the unfiltered volume of sump, the collection chamber also having a drain exit;

a supply conduit mounted to the sump, an entrance of the supply conduit positioned such that the entrance of the supply conduit is contiguous and in fluid communication with the filtered volume of sump;

a pump coupled to the supply conduit and operable to urge liquid from the filtered volume of sump into the supply conduit;

a valve fluidly coupled to the pump, the valve selectively adjustable between a recirculation configuration and a drain configuration;

a first outlet conduit extending from the valve and configured for supplying liquid from the pump to the spray body when the valve is in the recirculation configuration;

a second outlet conduit extending from the valve and configured for directing liquid from the pump to the collection chamber when the valve is in the drain configuration; and a check valve positioned at the entrance of the collection chamber, the check valve configured for obstructing liquid flow from the collection chamber to the unfiltered volume of the sump via the entrance of the collection chamber such that liquid in the collection chamber exits the collection chamber via the drain exit when the valve is in the drain configuration, wherein the filter is a fine filter, the dishwasher appliance further comprising a coarse filter positioned over the filtered volume of the sump between a wash chamber of the tub and the filtered volume of the sump, the sump defining an opening at a top portion of the fine filter, the opening of the sump contiguous and in fluid communication with the wash chamber of the tub.

2. The dishwasher appliance of claim 1, wherein the filter comprises a cylindrical frame and a filter medium mounted to the cylindrical frame.

3. The dishwasher appliance of claim 1, wherein a side wall of the sump and a bottom wall of the collection chamber are integrally formed from single, continuous piece of plastic.

4. The dishwasher appliance of claim 3, wherein the inner wall of the sump disposed between the collection chamber and the unfiltered volume of the sump is a separate piece of plastic from the single, continuous piece of plastic that integrally forms the side wall of the sump and the inner wall of the collection chamber.

5. The dishwasher appliance of claim 1, wherein the pump is the only pump within the dishwasher appliance for recirculating wash fluid within tub and for draining wash fluid from the tub.

6. The dishwasher appliance of claim 1, wherein the valve comprises a housing, a flapper and a solenoid, the housing defining a first outlet that is contiguous with the first outlet conduit and a second outlet that is contiguous with the second outlet conduit, the flapper pivotally mounted within the housing such that the flapper is positioned over the first outlet in the drain configuration and over the second outlet in the recirculation configuration, the solenoid coupled to the flapper.

7. The dishwasher appliance of claim 1, wherein the inner wall of the sump defines at least one jet, each jet of the at least one jet on the inner wall of the sump positioned and oriented for directing a stream liquid from the collection chamber towards the filter when the valve is in the drain configuration.

8. The dishwasher appliance of claim 7, wherein each jet of the at least one jet on the inner wall of the sump is positioned and oriented for directing the stream liquid from the collection chamber towards the filter in order to clean a filter medium of the filter when the valve is in the drain configuration.

9. The dishwasher appliance of claim 1, wherein the check valve comprises a ball having a circumference that is greater than a circumference of the entrance of the collection chamber, the ball having a density that is greater than a density of water.

10. A fluid circulation assembly for a dishwasher appliance, comprising:

a sump;

a filter positioned within the sump, the filter disposed between a filtered volume of the sump and an unfiltered volume of the sump;

a collection chamber positioned below the sump such that an inner wall of the sump is disposed between the collection chamber and the unfiltered volume of the sump, an entrance of the collection chamber positioned such that the entrance of the collection chamber is contiguous and in fluid communication with the unfiltered volume of sump, the collection chamber also having a drain exit;

a supply conduit mounted to the sump, an entrance of the supply conduit positioned such that the entrance of the supply conduit is contiguous and in fluid communication with the filtered volume of sump;

a pump coupled to the supply conduit and operable to urge liquid from the filtered volume of sump into the supply conduit;

a valve fluidly coupled to the pump, the valve selectively adjustable between a recirculation configuration and a drain configuration;

a first outlet conduit extending from the valve and configured for receiving liquid from the pump when the valve is in the recirculation configuration;

a second outlet conduit extending from the valve and configured for directing liquid from the pump to the collection chamber when the valve is in the drain configuration; and a check valve positioned at the entrance of the collection chamber, the check valve configured for obstructing liquid flow from the collection chamber to the unfiltered volume of the sump via the entrance of the collection chamber such that liquid in the collection chamber exits the collection chamber via the drain exit when the valve is in the drain configuration, wherein the filter is a fine filter, the fluid circulation assembly further comprising a coarse filter positioned over the filtered volume of the sump, the fine filter defining an opening at a top portion of the fine filter that is not covered by the coarse filter.

11. The fluid circulation assembly of claim 10, wherein the filter comprises a cylindrical frame and a filter medium mounted to the cylindrical frame.

12. The fluid circulation assembly of claim 10, wherein a side wall of the sump and a bottom wall of the collection chamber are integrally formed from single, continuous piece of plastic.

13. The fluid circulation assembly of claim 12, wherein the inner wall of the sump disposed between the collection chamber and the unfiltered volume of the sump is a separate piece of plastic from the single, continuous piece of plastic that integrally forms the side wall of the sump and the inner wall of the collection chamber.

14. The fluid circulation assembly of claim 10, wherein the pump is the only pump for recirculating wash fluid for draining wash fluid within the fluid circulation assembly.

15. The fluid circulation assembly of claim 10, wherein the valve comprises a housing, a flapper and a solenoid, the housing defining a first outlet that is contiguous with the first outlet conduit and a second outlet that is contiguous with the second outlet conduit, the flapper pivotally mounted within the housing such that the flapper is positioned over the first outlet in the drain configuration and over the second outlet in the recirculation configuration, the solenoid coupled to the flapper.

16. The fluid circulation assembly of claim 10, wherein the inner wall of the sump defines at least one jet, each, et of the at least one jet on the inner wall of the sump positioned and oriented for directing a stream liquid from the collection chamber towards the filter when the valve is in the drain configuration.

17. The fluid circulation assembly of claim 16, wherein each jet of the at least one jet on the inner wall of the sump is positioned and oriented for directing the stream liquid from the collection chamber towards the filter in order to clean a filter medium of the filter when the valve is in the drain configuration.

18. The fluid circulation assembly of claim 10, wherein the check valve comprises a ball having a circumference that is greater than a circumference of the entrance of the collection chamber, the ball having a density that is greater than a density of water.

* * * * *